United States Patent [19]

Beil et al.

[11] 3,968,881

[45] July 13, 1976

[54] MULTIPLE STACKING LETTER TRAY

[75] Inventors: Valentin E. Beil, Eden; Francis J. Ihlenfeld, West Seneca, both of N.Y.

[73] Assignee: McDonald Products Corporation, Buffalo, N.Y.

[22] Filed: Sept. 30, 1974

[21] Appl. No.: 510,795

[52] U.S. Cl. ..... 211/128; 211/133

[51] Int. Cl.[2] ..... A47F 3/14; B42F 17/00

[58] Field of Search ..... 211/11, 126, 128, 130, 211/133, 148, 177; 206/506, 509, 510, 511, 821

[56] References Cited

UNITED STATES PATENTS

| | | | |
|---|---|---|---|
| 1,688,407 | 10/1928 | Wastak | 206/511 X |
| 2,256,996 | 9/1941 | Bales | 211/128 X |
| 2,466,552 | 4/1949 | McCarty | 211/128 |
| 2,747,748 | 5/1956 | Barefoot | 211/126 |
| 2,869,731 | 1/1959 | Axelrod | 211/148 |
| 2,901,120 | 8/1959 | Abrahamson | 211/126 |
| 3,018,003 | 1/1962 | Lockwood | 211/126 |
| 3,095,093 | 6/1963 | Pelak | 211/126 |
| 3,180,288 | 4/1965 | McCowan | 211/126 X |
| 3,648,849 | 3/1972 | Harris et al. | 211/126 |

FOREIGN PATENTS OR APPLICATIONS

| | | | |
|---|---|---|---|
| 1,231,203 | 4/1960 | France | 211/126 |
| 1,055,345 | 4/1959 | Germany | 211/126 |
| 864,942 | 4/1961 | United Kingdom | 211/126 |
| 934,679 | 8/1963 | United Kingdom | 211/126 |

*Primary Examiner*—Roy D. Frazier
*Assistant Examiner*—Thomas J. Holko
*Attorney, Agent, or Firm*—Christel & Bean

[57] ABSTRACT

A tray support bracket of unitary, one piece construction having leg portions diverging downwardly from a U-shaped upper end portion and terminating at their lower ends in attaching feet, the feet and upper end portion lying in substantially parallel planes extending substantially normal to the plane of the leg portions. Tray members have a first pair of foot pads for engaging the support bracket feet and a second pair of footpads for engaging the upper end portion of the support bracket. The tray members and support brackets are interchangeable, with the latter supporting the former in a vertically spaced, stacked arrangement of two or more tray members.

8 Claims, 7 Drawing Figures

MULTIPLE STACKING LETTER TRAY

BACKGROUND OF THE INVENTION

This invention relates to the letter tray art, and more particularly to a new and useful multiple stacking letter tray construction.

It is well known to provide a stacked letter tray in which one or more individual letter trays are supported in vertically spaced relation, and various support brackets and attachments therefor have been proposed. Often the bracket used for supporting a double tier arrangement will differ from the bracket for a triple tier arrangement, requiring the production and inventorying of different bracket constructions and reducing the flexibility of the arrangement interchangeability of its components.

SUMMARY OF THE INVENTION

The primary object of this invention is to provide a multiple stacking letter tray utilizing the same tray support bracket regardless of the number of trays in the stack, which tray support bracket and associated attachments are simple and relatively inexpensive in construction and esthetically pleasing in appearance.

A multiple stacking letter tray of this invention is characterized in one aspect thereof by the provision of tray support members adapted for attachment at the upper and lower ends thereof to a pair of vertically spaced tray members each adapted for attachment both to the lower end of one support member and to the upper end of another support member, thereby enabling the stacking of two or more tray members with support members of the same construction.

The foregoing and other objects, advantages and characterizing features of this invention will become apparent from the ensuing detailed description of an illustrative embodiment thereof, reference being made to the accompanying drawings wherein like references numerals denote like parts throughout the various views.

BRIEF DESCRIPTION OF DRAWING FIGURES

DESCRIPTION OF THE ILLUSTRATED EMBODIMENTS

Figure 1:
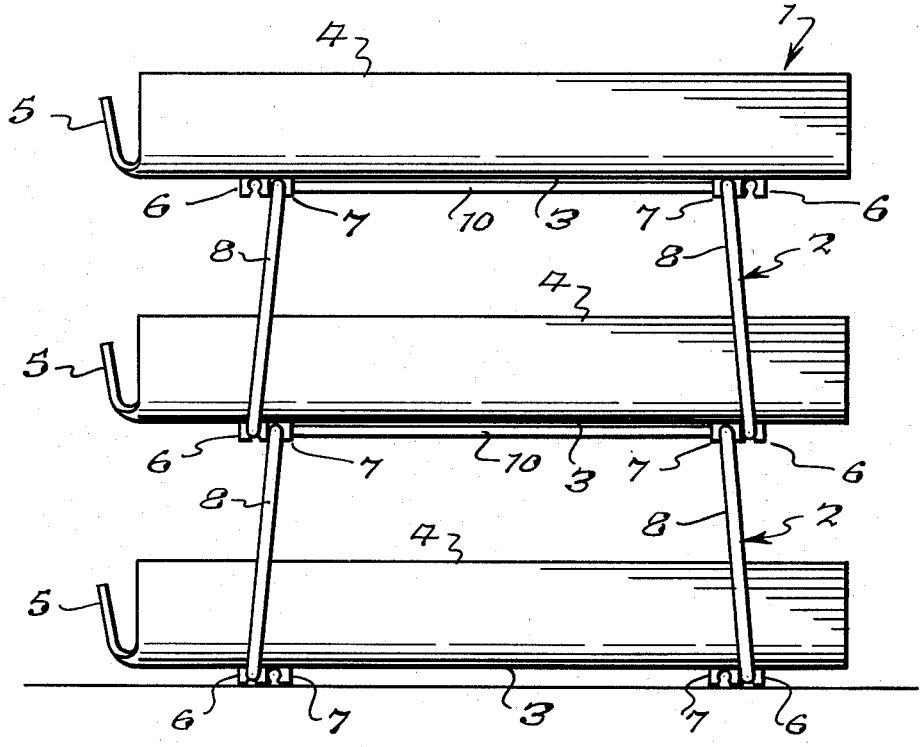
FIG. 1 is a view in side elevation of a multiple stacking tray construction of this invention.

Referring now in detail to the illustrative embodiment depicted in the accompanying drawings, there is shown a multiple stacking letter tray consisting of three individual tray members, each generally designated 1, supported in vertically spaced relation by support members each generally designated 2.

Tray members 1 are identical, each having a bottom wall 3, upstanding opposite side walls 4, and an upstanding end wall 5 at one end thereof, the opposite end being open to facilitate the placement of letters or other material in the tray and the removal of such material therefrom. On the underside of bottom wall 3 are pairs of footpads 6 and 7, the pads 6 being spaced apart lengthwise of the tray a distance slightly greater than the pads 7, and also being inwardly offset therefrom, there being pairs of footpads 6 and 7 adjacent each of the opposite sides of the tray in inwardly spaced relation thereto.

Figure 3:
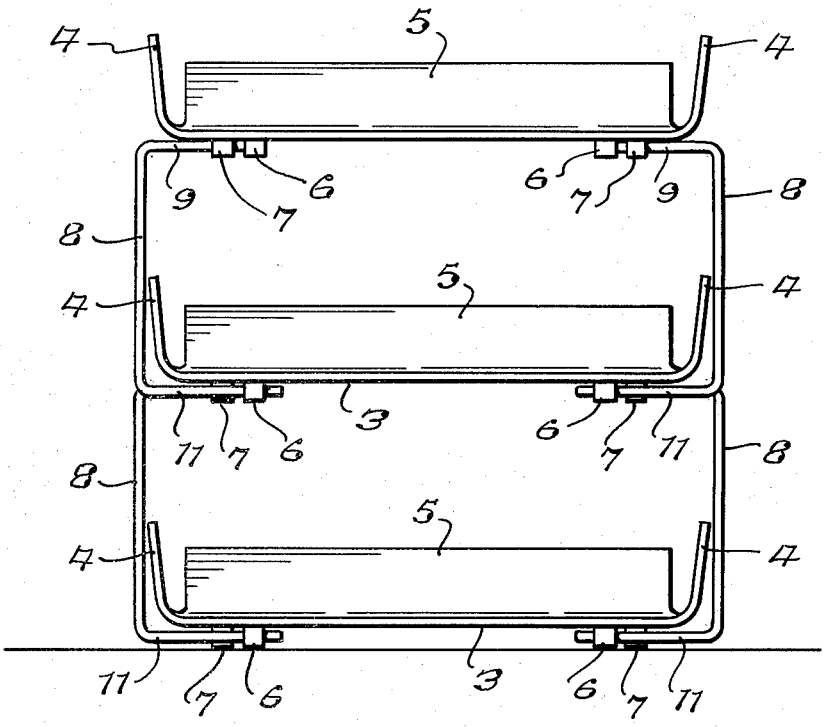
FIG. 3 is an end elevational view thereof.
Figure 4:
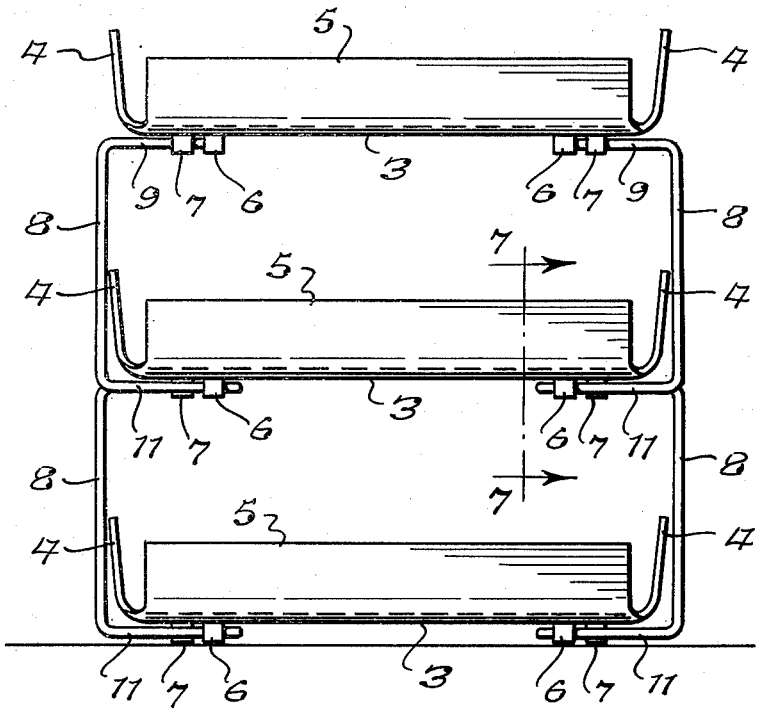
FIG. 4 is an opposite end elevational view thereof.

Tray support members 2 also are identical, each comprising a unitary, one-piece member formed, for example of a steel rod and shaped to provide a pair of normally generally upright leg portions 8 joined at their upper ends by a generally U-shaped bridging portion consisting of inwardly extending side portions 9, extending inwardly from the upper ends of legs 8 and leading to a bight portion 10. At their lower ends, portions 8 terminate in inturned attaching foot portions 11. Leg portions 8 diverge downwardly in their normal position of use, as clearly shown in FIG. 1, lying in a common plane which is normally vertical, as shown in FIGS. 3 and 4. The U-shaped bridging portion 9, 10 and the attaching foot portions 11 lie in generally parallel planes extending at substantially a right angle to the plane of legs 8, the foot portions 11 extending from the plane of legs 8 slightly further than the upper end portion 9, 10.

Figure 2:
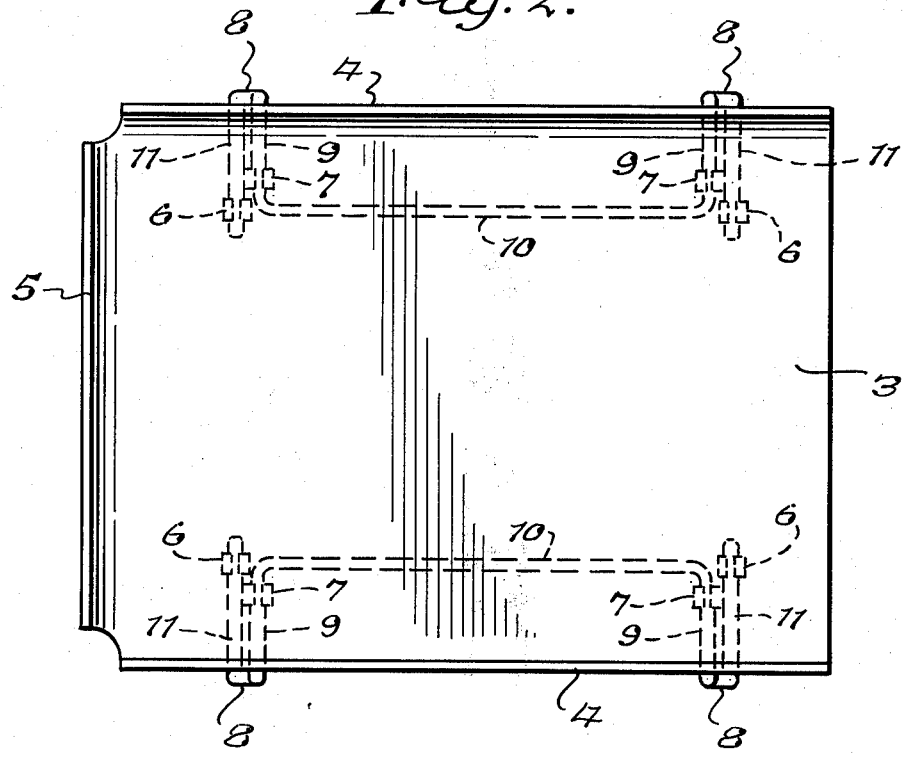
FIG. 2 is a top plan view thereof.
Figure 5:
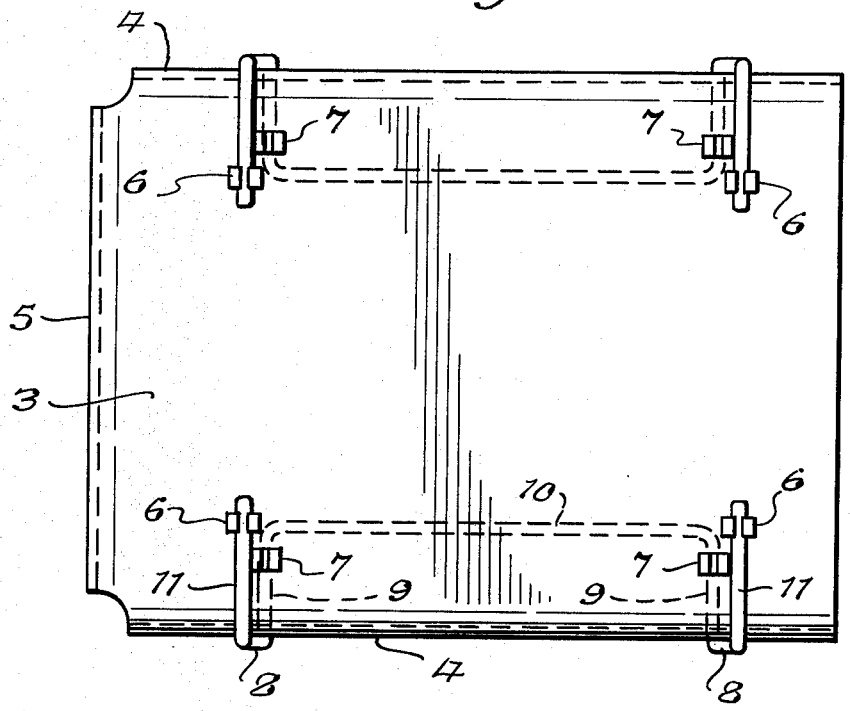
FIG. 5 is a bottom plan view thereof.
Figure 6:
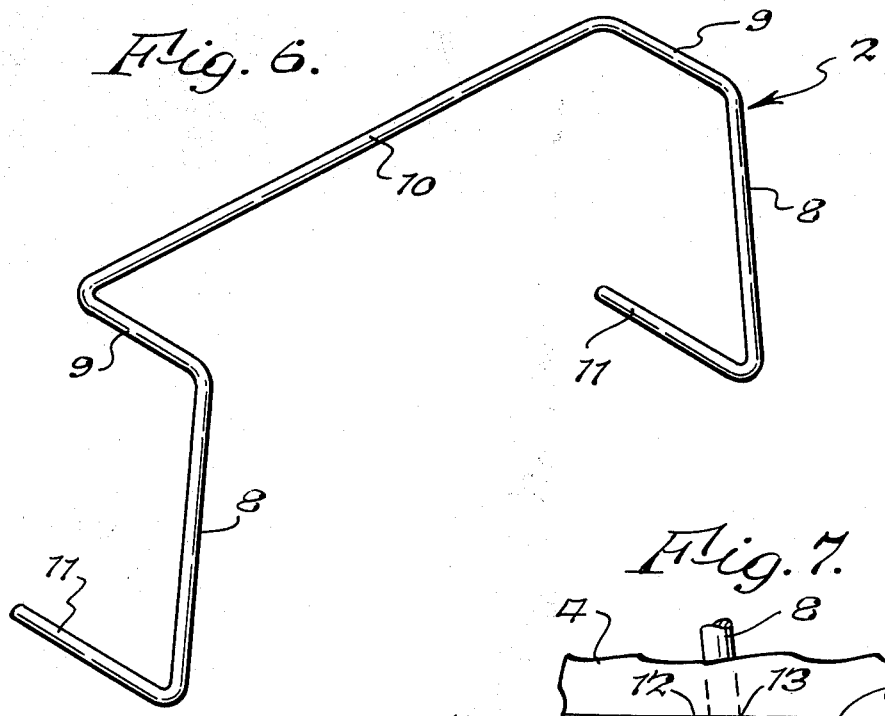
FIG. 6 is a perspective view of one of the tray support members.
Figure 7:
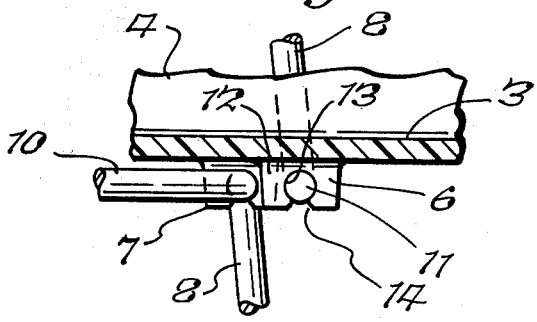
FIG. 7 is a fragmentary sectional view, taken about on line 7—7 of FIG. 4, on an enlarged scale.

Being of one piece, unitary construction the tray support members 2 are easy to handle and to assemble to the individual tray members. As seen from the plan views of FIGS. 2 and 5, the side portions 9 at the upper end of each support bracket have snap-fit engagement with the footpads 7 on one side of the upper tray member, while the attaching feet 11 have snap-fit engagement with the pads 6 on the same side of the tray immediately below, the downward divergence of leg portions 8 causing the attaching feet 11 to be spaced apart sufficiently to pass by the outer pair of footpads 7 into engagement with the inner pair of pads 6. As seen in FIG. 7, each footpad 6 and 7 is formed of a pair of spring fingers 12 projecting from the underside of the tray 1 and defining between them a generally cylindrical, rod receiving recess 13 opening through an inlet defined by walls diverging from a restricted throat, the legs 12 being forced apart by the camming action of the rod portions 9 or 11 engaging the opposite sides of the inlet 14 and snapping past the throat into recess 13, for secure but releasable engagement therein.

Tray members 1 can be formed of any suitable material, for example a suitable plastic material and can have footpads 6 and 7 either molded thereon or bonded thereto. In use, a pair of trays are assembled with the feet 11 of a pair of supports 2 engaging the pads 6 of the bottom tray on each side thereof, and with the attaching portions 9 at the upper end of the supports engaging the pads 7 on opposite sides of the tray immediately above. In a triple tray arrangement, as illustrated, the intermediate tray engages the upper end portions 9 of the lower pair of supports 2, and also the attaching portions 11 of the upper pair of supports, and it is a particular feature of this invention that the individual trays are vertically stacked in an esthetically pleasing manner, using tray supports which are identical and interchangeable and of an extremely simple and inexpensive construction. The same tray supports are used regardless of the number of trays to be stacked, and the tray members preferably also are identical, although they can vary as long as they have footpads 6, 7 or the like.

We claim:

1. A multiple stacking letter tray comprising a first tray member, a second tray member, and means including a tray support member supporting said second tray member in vertically spaced relation above said first tray member, said tray support member having leg portions extending between said tray members in downwardly diverging relation and terminating at their lower ends in horizontal foot portions extending therefrom into connected engagement with the underside of said first tray member, and a generally U-shaped horizontal upper end portion extending between the upper ends of said leg portions and connected to the underside of said second tray member in supporting relation thereto and each of said tray members having a pair of laterally spaced footpads on the underside thereof for respectively engaging said foot portions of said lower ends and said U-shaped upper end portion of said tray support member, all of said footpads having spring fingers for engaging around and receiving said support member horizontal portions with a snap fit.

2. A multiple stacking letter tray according to claim 1, wherein said support member is of one piece construction.

3. A multiple stacking letter tray according to claim 1, wherein there are a pair of such support members, one on each side of said stacking tray, each of said support members being connected at its lower end to said first tray member and at its upper end to said second tray member.

4. A multiple stacking letter tray according to claim 1, there being a first pair of such tray support members, one on each side of said stacking tray, supporting said second tray member above said first tray member, together with a third tray member and a second pair of such tray support members supporting said third tray member in vertically spaced relation above said second tray member, said tray support members being identical in construction, said first pair of tray support members being connected at their lower ends to said first tray member and at their upper ends to said second tray member, and said second pair of tray support members being connected at their lower ends to said second tray member and at their upper ends to said third tray member.

5. A multiple stacking letter tray as set forth in claim 4, said tray members also being identical in construction and having on opposite sides of the bottom thereof a first pair of footpads for engaging the lower ends of one of said support members and a second pair of footpads for engaging the upper end of one of said support members.

6. A multiple stacking letter trays as set forth in claim 5, wherein said paids of said first pairs thereof are spaced apart a distance greater than the spacing between said pads of said second pairs thereof.

7. A multiple stacking letter tray comprising a first tray member, a second tray member, and a third tray member, and a first pair of tray support members, one on each side of said stacking trays, supporting said second tray above said first tray member, each of said tray support members having leg portions extending between said tray members in downwardly diverging relation and terminating at their lower ends in foot members extending therefrom into connected engagement with said first tray member, and a generally U-shaped upper end portion extending between the upper ends of said leg portions and connected to said second tray member in supporting relation thereto, and a second pair of tray support members supporting said third tray member in vertically spaced relation above said second tray member, said tray support members being identical in construction, said second pair of tray support members being connected at their lower ends to said second tray member and at their upper ends to the third tray member, and said tray members also being identical in construction and having on opposite sides of the bottoms thereof a first pair of foot pads for engaging the lower ends of one of said support members and a second pair of foot pads for engaging the upper end of one of said support members wherein said pads of said first pairs thereof are spaced apart a distance greater than the spacing between said pads of said second pairs thereof.

8. A multiple stacking letter tray as set forth in claim 7, said pads having spring fingers for engaging around and receiving said support member portions with a snap fit.

* * * * *

UNITED STATES PATENT AND TRADEMARK OFFICE

CERTIFICATE OF CORRECTION

PATENT NO. : 3,968,881

DATED : July 13, 1976

INVENTOR(S) : Valentin E. Beil and Francis J. Ihlenfeld

It is certified that error appears in the above–identified patent and that said Letters Patent are hereby corrected as shown below:

Claim 6, line 1 "trays" should be --tray--; same claim, line 2 "paids" should be --pads--.

Claim 7, line 19 "the" should be --said--.

Signed and Sealed this

Twelfth Day of October 1976

[SEAL]

*Attest:*

RUTH C. MASON
*Attesting Officer*

C. MARSHALL DANN
*Commissioner of Patents and Trademarks*